United States Patent [19]

Harris

[11] Patent Number: 4,683,923

[45] Date of Patent: Aug. 4, 1987

[54] CLIP FOR USE WITH GASOLINE PUMP DISPENSING HANDLE

[76] Inventor: Charles M. Harris, 9070 Alena Ct. NW., North Fort Myers, Fla. 33903

[21] Appl. No.: 866,755

[22] Filed: May 27, 1986

[51] Int. Cl.[4] ..... B65B 3/04

[52] U.S. Cl. ..... 141/392; 74/526; 251/90; 24/571

[58] Field of Search ..... 141/98, 392, 1; 74/526; 251/90, 111; 7/100; 220/DIG. 33; 24/563–571

[56] References Cited

U.S. PATENT DOCUMENTS 4,236,552 12/1980 Rayboy ..... 141/392

*Primary Examiner*—Houston S. Bell, Jr.

*Attorney, Agent, or Firm*—Merrill N. Johnson

[57] ABSTRACT

A clip for holding the lever of a gasoline pump dispensing handle in open gasoline dispensing position made from a single flat plate of uniform thickness having a rear shank about 1½ inches in length with a pair of identical arms extending about 1½ inches from the opposite ends of the shank and forming between said arms an angle of approximately 40 degrees. A serrated row of similar flat-topped teeth lies along the inner edge of each arm with the flat tops of each serrated row of teeth lying in a common plane and the two planes containing said flat tops intersecting each other at an angle of approximately 40 degrees. Preferably each row contains six flat-topped teeth.

4 Claims, 5 Drawing Figures

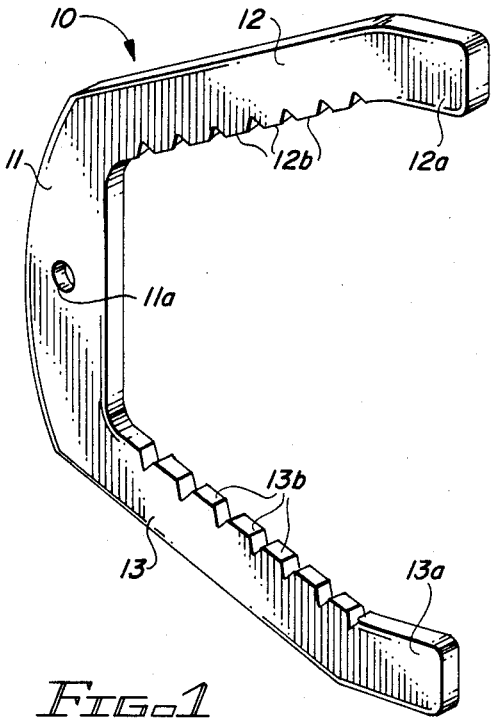
FIG. 1
FIG. 2
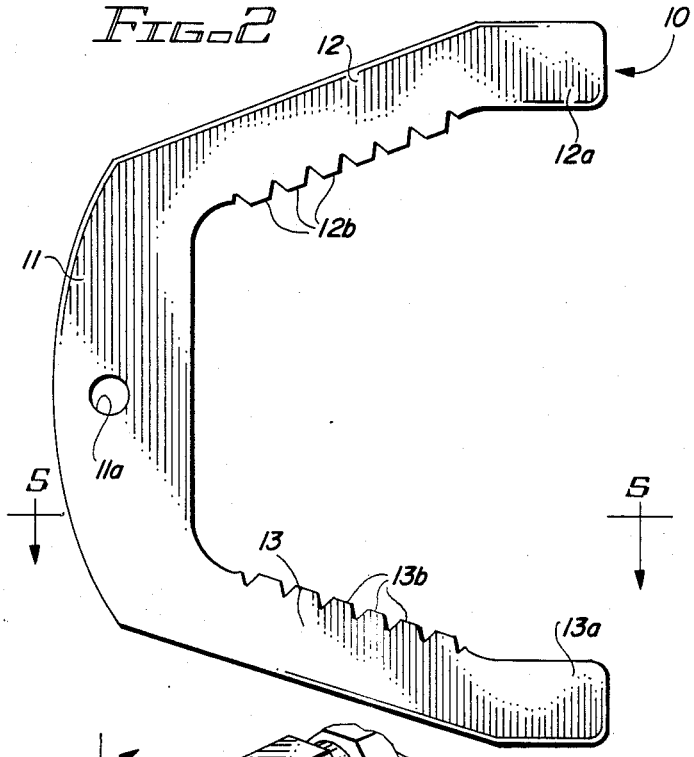
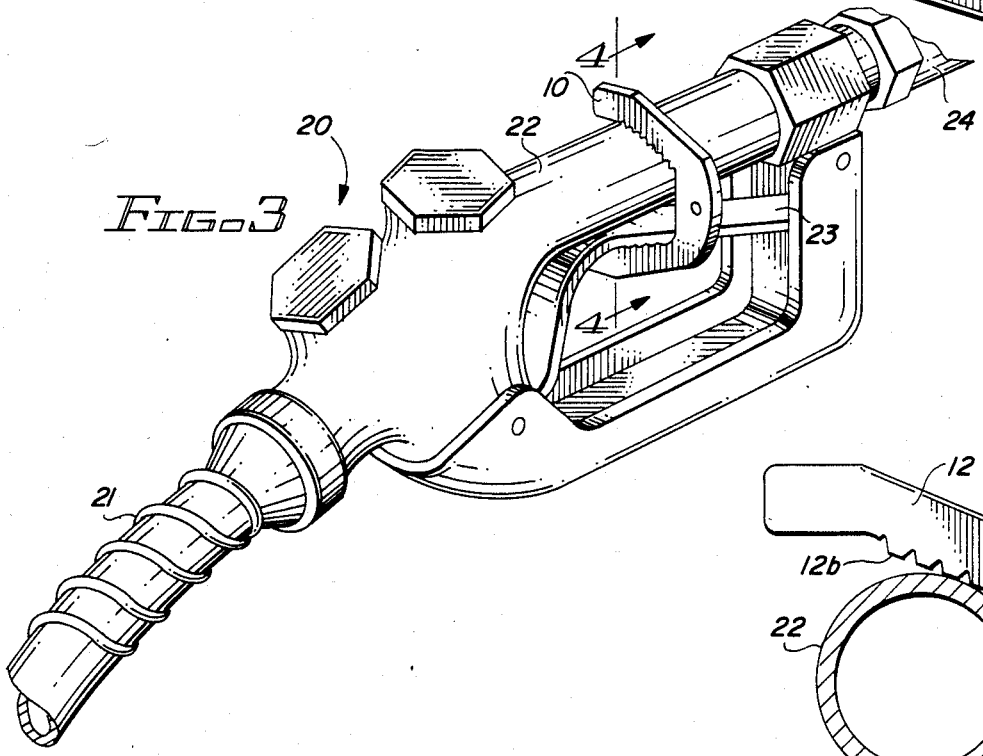
FIG. 3
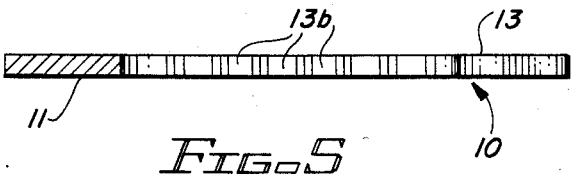
FIG. 5
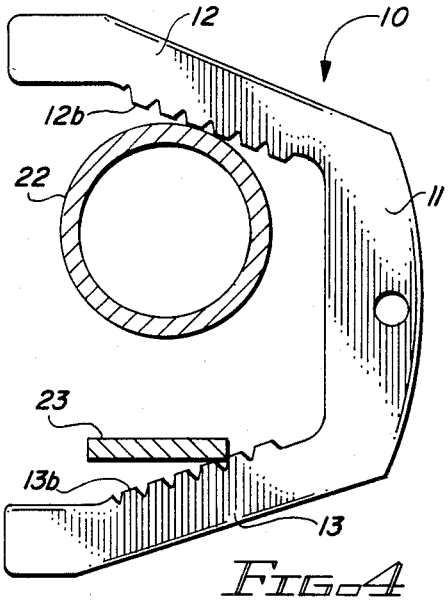
FIG. 4

CLIP FOR USE WITH GASOLINE PUMP DISPENSING HANDLE

BACKGROUND AND SUMMARY OF THE INVENTION

My invention relates to gasoline pump dispensing handles used on pumps in self-service stations. More particularly, my invention is a unique clip designed to hold the dispensing handle in operating (gasoline dispensing) position so that the customer using the pump will not have to keep the handle in operating position by continuing to grasp the handle during the entire time his vehicle's tank is being filled.

Conventional gasoline dispensing handles used in service stations include an automatic shut-off valve which shuts off the flow of gasoline when the tank is full and gasoline begins to fill the filler pipe. Dispensing handles used by attendants of full service pumps are conventionally equipped with a pivoted latch so that the actuating lever can be held open without the attendant keeping a hand on the handle, but these latches are typically removed from self-service pumps.

This lack of a pivoted latch frustrates self-service customers who do not wish to continue holding the handle during the entire filling operation. It also exposes the customer to gasoline-soaked hands, clothing and shoes in the event of over-filling or malfunction of the dispensing mechanism.

A number of devices to keep the dispensing handle in open or operating position have been suggested including the devices shown and described in prior U.S. Pat. Nos. 4,200,128; 4,216,807; 4,278,116; 4,287,736; U.S. Pat. No. Des. 254,837 and U.S. Pat. No. Des. 255,066. However, so far as I am aware, these prior art devices have met with little commercial success.

My unique clip is convenient to carry and may, if desired, be carried on the driver's key ring. It may be made of metal or high strength plastic material and being quite simple it is inexpensive to manufacture. Most important, it can be used on almost any type of conventional dispensing handle quickly and without fear of failure or malfunction.

In its preferred form, my clip consists of a C-shaped metal plate of uniform thickness having a rear shank from which two similar arms project at an angle between themselves of approximately 40 degrees. Along the inside face of each of these two arms are six spaced-apart similar flat-faced teeth. It is these teeth which permit my clip to work without slippage or failure on almost all known types of dispensing handles.

BRIEF DESCRIPTION OF THE DRAWINGS

FIG. 1 is a perspective view of a preferred form of my clip for holding a conventional gasoline dispensing handle in operating (open) position.

FIG. 2 is a side view of the clip shown in FIG. 1.

FIG. 3 is a perspective view of the clip shown in FIG. 1 being used to hold the actuating lever of a gasoline dispensing handle in operating (open) position.

FIG. 4 is a cross-sectional view taken along line 4—4 of FIG. 3 showing my clip secured onto the pipe and operating lever of a gasoline dispensing handle.

FIG. 5 is a cross-sectional view taken along line 5—5 of FIG. 2 showing the inside face of one of the arms of the clip.

DETAILED DESCRIPTION OF THE PREFERRED EMBODIMENT

Referring first to FIGS. 1 and 2 of the drawings, a preferred form of my clip 10 is formed from a $\frac{1}{8}$th inch metal plate, although the clip can be made from other metals or high strength thermoplastic material such as polystyrene.

Clip 10 is generally C-shaped and consists of a rear shank 11 approximately $1\frac{1}{2}$ inches in length with a cylindrical hole 11*a* in its center so that clip 10 can be carried on a key chain. Two identical arms 12 and 13 extend about $1\frac{1}{2}$ inches from the opposite ends of shank 11 at an angle between themselves of about 40 degrees. Preferably the extreme ends of arms 12 and 13 curve inwardly to form parallel ends 12*a* and 13*a* respectively.

The inner edges of arms 12 and 13 are serrated to form preferably six identical teeth 12*b* and 13*b*. As best shown in FIGS. 1 and 5, each of teeth 12*b* and 13*b* has a flat planar top surface with a series of sharp V-shaped grooves separating the flat tops of adjacent teeth. The flat tops of teeth 12*b* lie in the same plane as do the tops of all six teeth 13*b*. The six teeth extend along each arm for a distance of approximately $\frac{3}{4}$ths of an inch.

The inner end of the row of teeth 12*b* lies about $1\frac{1}{4}$ inches from the inner end of the row of teeth 13*b*, while the outer end of the row of teeth 12*b* lies about $1\frac{3}{4}$ inches from the outer end of the row of teeth 12*b*. The plane containing the flat tops of teeth 12*b* intersects the plane containing the flat tops of teeth 13*b* at an angle of about 40 degrees.

Referring now to FIGS. 3 and 4, a conventional gasoline dispensing pump handle 20 is designed to dispense gasoline from a base 24 through pipe 22 and nozzle 21 into the filler tube of an automobile gasoline tank (not shown). When the gasoline pump's motor is operating, lever 23 is moved upwards toward pipe 22 to open the valve in handle 20 and thus dispense gasoline into nozzle 21, the automobile's filler tub and into the gasoline tank.

To use clip 10, lever 23 is manually squeezed upwardly into the position shown in FIG. 3 to open the handle's valve. When gasoline flow has been established, clip 10 is inserted into the position shown in FIGS. 3 and 4 where it will be held in place by the spring mechanism which urges the lever into a downwardly (closed) position.

Thus the pump operator is freed of the chore of squeezing the handle to maintain the flow of gasoline into the automobile's tank. Gasoline flow will, of course, automatically cease when gasoline begins to fill up the auto's filler tube. At that time clip 10 can be removed from the pump handle.

While I have shown and described a preferred embodiment of my invention, various changes and modifications may be made without departing from the spirit and scope of my invention. The scope of my clip for use with gasoline dispensing handles is limited only by the scope of the appended claims.

I claim:

1. A clip for holding the lever of a gasoline pump dispensing handle in open gasoline dispensing position, said clip being formed as a thin flat device of uniform thickness comprising a rear shank approximately $1\frac{1}{2}$0 inches in length;

a pair of identical arms extending approximately $1\frac{1}{2}$ inches from the opposite ends of the rear shank with the arms forming between themselves an angle of approximately 40 degrees; and a serrated row of identical flat-topped teeth lying along the inner edge of each of the clip's two arms, the flat tops of each serrated row of teeth lying in a common plane, and the two planes containing said flat tops intersecting each other at an angle of approximately 40 degrees.

2. A clip as set forth in claim 1 wherein each row comprises a total of six flat-topped teeth.

3. A clip as set forth in claim 1 wherein each row of teeth consists of six identical flat-topped teeth and the distance between the innermost teeth of each row is approximately $1\frac{1}{4}$ inches and the distance between the outermost teeth of each row is approximately $1\frac{3}{4}$ inches.

4. A clip as set forth in claim 1 wherein the rear shank contains a cylindrical hole.

* * * * *